US006058861A

United States Patent [19]

Chou

[11] Patent Number: 6,058,861

[45] Date of Patent: May 9, 2000

[54] AIR CONTROL SWITCH SET FOR AN OVEREDGE SEWING MACHINE

[75] Inventor: Huang-Yuehe Chou, Chung Ho, Taiwan

[73] Assignee: Sicama Sewing Machine Co., Ltd., Taipei Hsien, Taiwan

[21] Appl. No.: 09/352,770

[22] Filed: Jul. 14, 1999

[51] Int. Cl.[7] ..... D05B 69/08

[52] U.S. Cl. ..... 112/276; 112/299; 112/DIG. 3

[58] Field of Search ..... 112/276, 162, 112/217.3, 220, 237, 239, 285, 299, DIG. 3

[56] References Cited

U.S. PATENT DOCUMENTS 3,667,410 6/1972 Bianchi ..... 112/239 X
3,812,801 5/1974 Lukowicz ..... 112/276 X
4,271,775 6/1981 Tice ..... 112/276
5,495,817 3/1996 Zeigler, Sr. et al. ..... 112/217.3

*Primary Examiner*—Peter Nerbun
*Attorney, Agent, or Firm*—Bacon & Thomas

[57] ABSTRACT

An air control switch set for a switching machine, including a base frame, an air control valve fixedly mounted on the base frame to guide air from an air source to an air nozzle and thread suction device, a switch controlled to close/open the air control valve, a control bar vertically slidably coupled to the base frame and reciprocated by a pedal, a pull rod having a bottom end fixedly fastened to the base frame and a top end coupled to a motor through a link, a stop member fixedly mounted on the control bar, and a rocker arm turned about a pivot at the base frame and forced by the stop member to press on the switch in opening the air control valve upon a down stroke of the control bar before the base frame is lowered with the control bar to move the link in turning on the motor.

4 Claims, 6 Drawing Sheets

AIR CONTROL SWITCH SET FOR AN OVEREDGE SEWING MACHINE

BACKGROUND OF THE INVENTION

The present invention relates to an air control switch set for an overedge sewing (overlock) machine which is coupled between a motor and a pedal, and driven by the pedal to let air pass to the desired location prior to starting of the motor, enabling the thread head to be accurately cut.

A regular air control switch set for an overedge sewing machine, as shown in FIG. 1, comprises a base frame 90. The base frame 90 comprises staggered top wall 91 and bottom wall 92, and staggered upper partition wall 93 and lower partition wall 94 horizontally disposed at different elevations. A first air control valve 80 is mounted on the upper partition wall 93, which is spaced below the top wall 91. The first air control valve 80 comprises a switch 81 facing the top wall 91. A pull rod 95 is inserted through a hole at the top wall 91 and a hole at the upper partition wall 93, having a top end coupled to a motor (not shown) and a bottom end coupled to the bottom wall 92. Springs 96 are respectively mounted on the pull rod 95, and retained between the top wall 91 and the upper partition wall 93 and, the lower partition wall 94 and the bottom wall 92. A second air control valve 70 and a link 97 are mounted on the lower partition wall 94. The second air control valve 70 is connected to an air nozzle and thread suction device. The link 97 has one end fixedly connected to the lower partition wall 94, and an opposite end inserted through a hole on the bottom wall 92 and coupled to a pedal (not shown). The second air control valve 70 communicates with the an air compressor (not shown), and the first air control valve 80 at the upper partition wall 93. The second air control valve 70 comprises a switch 71 facing the bottom wall 92. When the pedal is pressed down, the link 97 is lowered, causing the pull rod 95 and the lower partition wall 94 to be lowered with the link 97. When the pull rod 95 is lowered with the link 97, the motor is started, and therefore the overedge sewing machine is driven to reciprocate the threaded needle, at the same time the switch 71 of the second control air valve 70 is pressed on the bottom wall 92 to open the second air control valve 70, enabling air to pass out of the second air control valve 70 to the air nozzle and thread suction device. This structure of air control switch set is still not satisfactory in function. During stitching operation, the operator must apply much effort to press down the pedal in lowering the link 97, enabling the switch 71 of the second control air valve 70 to be positively pressed on the bottom wall 92 to open the second air control valve 70. Because the top wall 91 and the pull rod 95 are simultaneously moved when the link 97 is pulled downwards by the pedal, the motor may be started before the second control air valve 70 is opened to let air pass to the air nozzle and thread suction device at the beginning of a stitching operation or during a slow stitching operation (for example, a curved or fancy stitching operation), causing the thread head unable to be properly cut.

SUMMARY OF THE INVENTION

The present invention has been accomplished to provide an air control switch set for an overedge sewing machine which eliminates the aforesaid drawbacks. According to one aspect of the present invention, the air control switch set comprises a base frame, the base frame comprising a first lug and a second lug disposed at different elevations and vertically arranged in a line, and a pivot; a first air control valve fixedly mounted on the base frame, the first air control valve having an air input port connected to an air source, and an air output port connected to an air nozzle and thread suction device; first switch means mounted in the first air control valve and controlled to open/close the air output port of the first air control valve; a control bar inserted through the lugs at the base frame, the control bar having a top end extended out of the first lug at the base frame and a bottom end inserted through the second lug at the base frame and coupled to a pedal; first spring means mounted on the control bar, the first spring means having a bottom end connected to the first lug at the base frame and a top end connected to the top end of the control bar; second spring means mounted on the control bar, the second spring means having a bottom end connected to the bottom end of the control bar and a top end connected to the second lug at the base frame; a pull rod having a bottom end fixedly connected to the base frame and a top end coupled to a motor through a link; a stop member mounted on the control bar and moved with the control bar between the lugs at the base frame; and a rocker arm turned about the pivot at the base frame, the rocker arm having a first end disposed in contact with the first switch means and a second end suspended below the stop member; wherein when the control bar is pulled downwards by the pedal, the stop member is lowered with the control bar to press on the second end of the rocker arm against the second lug at the base frame and turn the rocker arm about the pivot, causing the first end of the rocker arm to press on the first switch means in opening the first air control valve for letting air pass to the air nozzle and thread suction device, and the base frame is lowered with the stop member during down stroke of the control bar after the second end of the rocker arm has been pressed on the second lug by the stop member, causing the pull rod to be lowered with the base frame to move the link in turning on the motor. According to another aspect of the present invention, the elevation of the stop member can be adjusted, so as to adjust the angle of rotation of the rocker arm, enabling the length of time in which air flows out of the first air control valve to the air nozzle and thread suction device to be relatively adjusted.

BRIEF DESCRIPTION OF THE DRAWINGS

FIG. 4 is similar to FIG. 2 but showing the air control switch set operated, the motor turned on.

DETAILED DESCRIPTION OF THE PREFERRED EMBODIMENT

Figure 1:
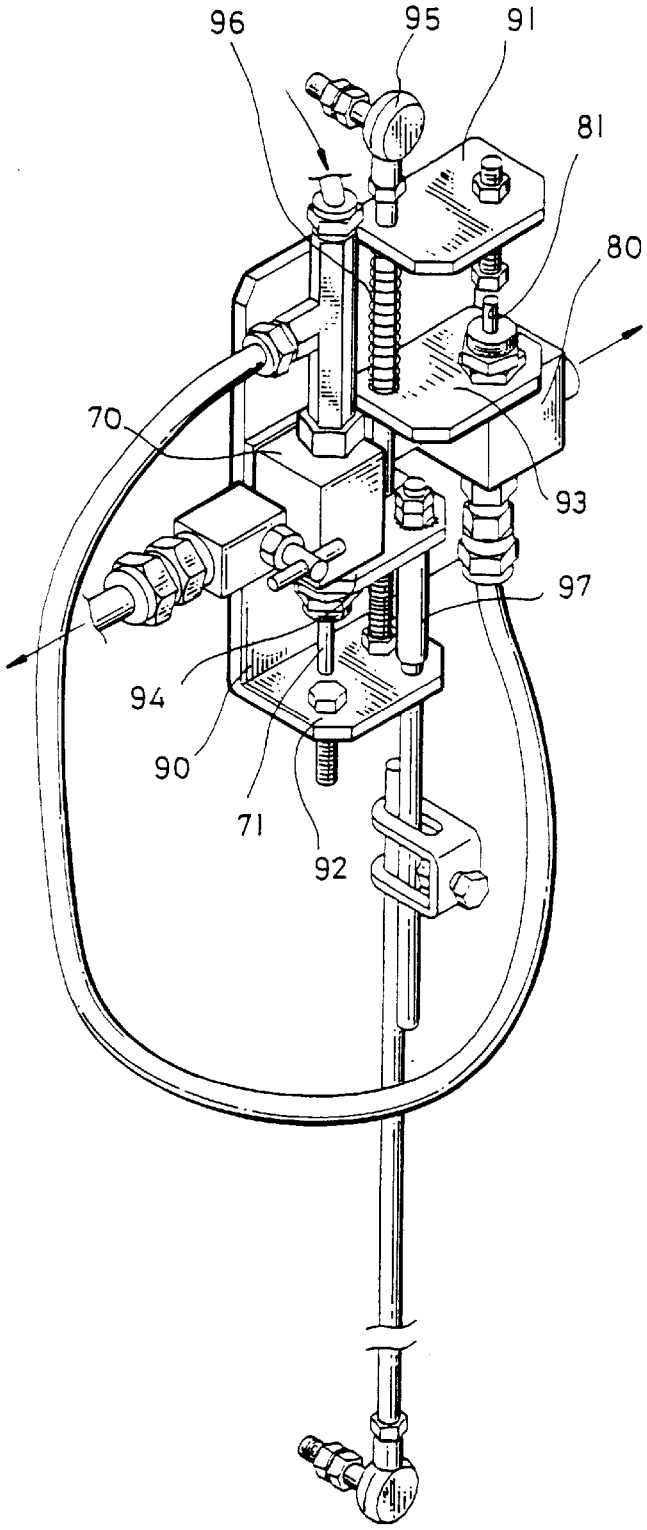
FiG 1 PRIOR ART
FIG. 1 is a perspective view of an air control switch set for an overedge sewing machine according to the prior art.
Figure 2:
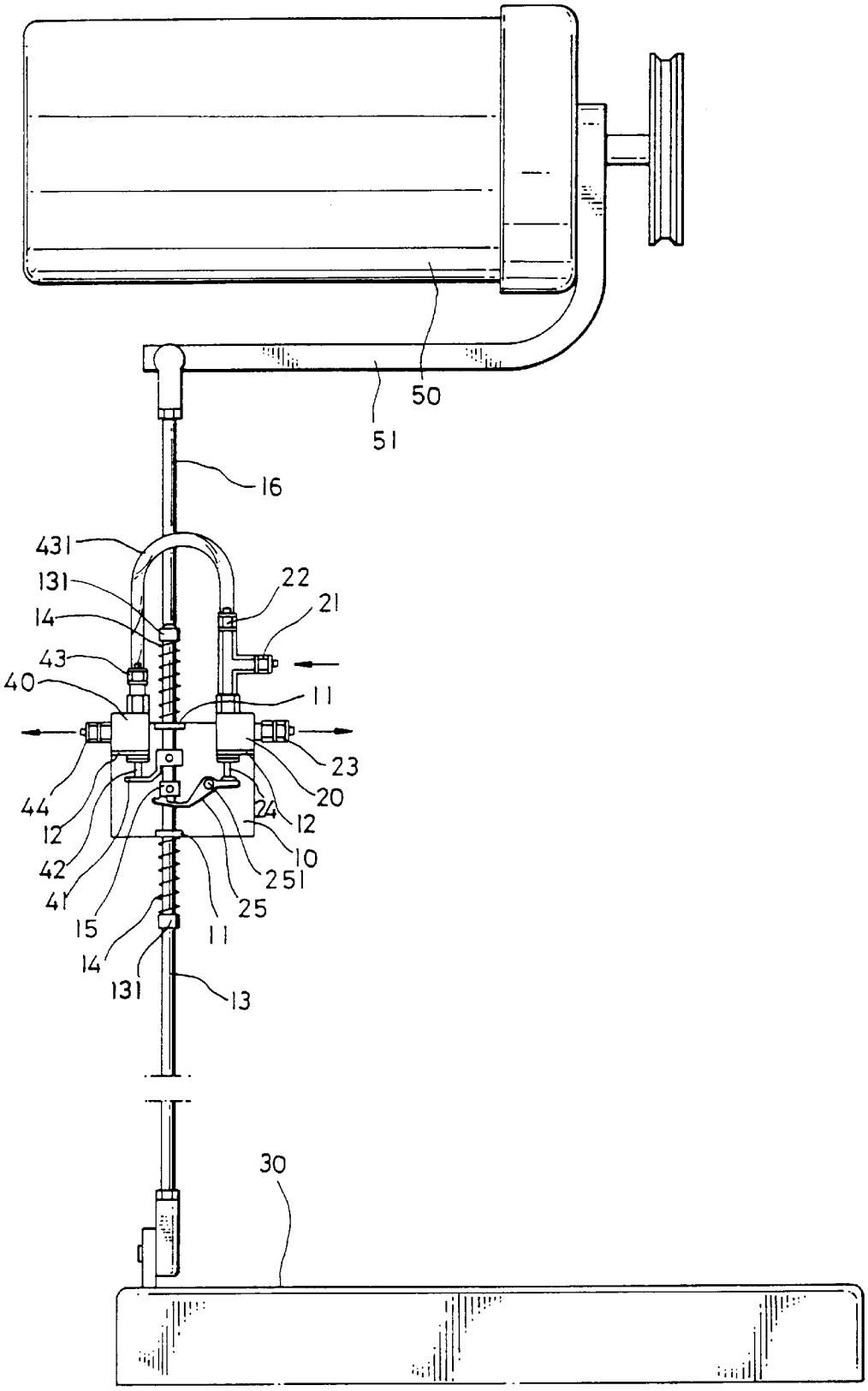
FIG. 2 is a perspective view of the present invention, showing the air control switch set coupled between a pedal and a motor in an overedge sewing machine.

Referring to FIG. 2, an air control switch set in accordance with the present invention comprises a base frame 10. The base frame 10 is, for example, a flat plate disposed in vertical, having two horizontal lugs 11 perpendicularly raised from top and bottom sides thereof and aligned in a line, and two horizontal boards 12 bilaterally raised from the front side thereof and equally spaced between the horizontal lugs 11. A first air control valve 20 is mounted on one horizontal board 12. A tee 21 is connected to one end namely the air input end of the first air control valve 20 for guiding air in. The tee 21 has a third port 22 (the first and second ports of the tee 21 are respectively connected to the first air control valve 20 and the air source). The first air control valve 20 has a connector 23 at its one lateral side for connection to an air nozzle and thread suction device (not shown), and a switch 24 at its bottom side. The switch 24 is operated to open/close the first air control valve 20 enabling air to flow out of the first air control valve 20, or be kept in the first air control valve 20.

Figure 5:
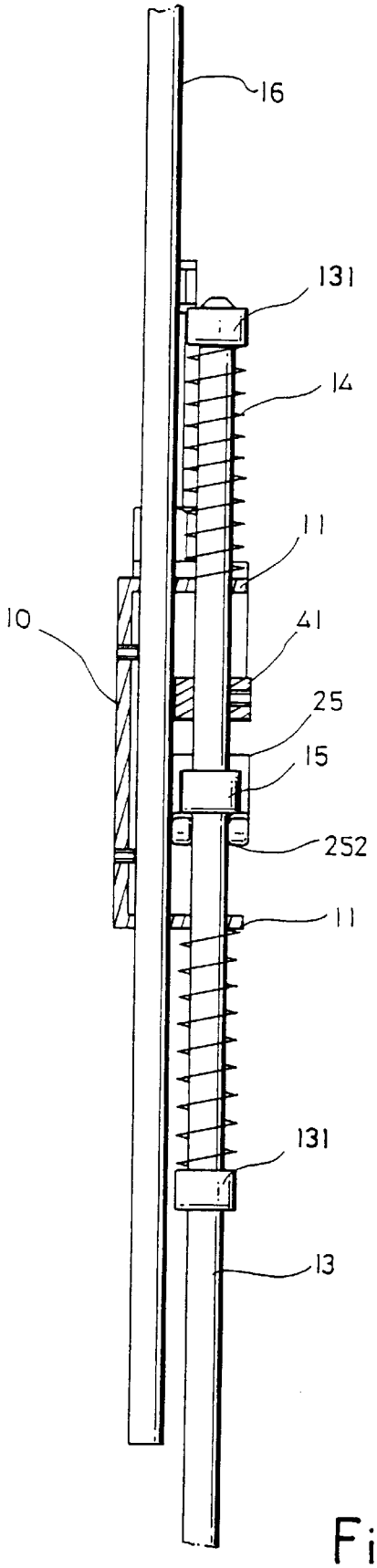
FIG. 5 is a side view in section of the present invention.

Referring to Figures from 3 through 5 and FIG. 2 again, a rocker arm 25 is turned about a pivot 251 at the base frame 10, having a first end disposed in contact with the switch 24 at the bottom, and a second end defining a hole 252 (see also FIG. 5). A control bar 13 is inserted through the hole 252 at the second end of the rocker arm 25, having a bottom end inserted through a hole at the bottom-sided lug 11 and coupled to a pedal 30 and a top end extended out of a hole at the top-sided lug 11. Two spring means for example compression springs 14 are respectively mounted on the control bar 13 at different elevations, and respectively connected between the lugs 11 and respective stop flanges 131 at top and bottom ends of the control bar 13 (as an alternate form of the present invention, stop pins may be fastened to the control bar 13 at different elevations to stop the compression springs 14 against the lugs 11). A stop member, for example, a stop ring 15 is fixedly mounted on the control bar 13 and pressed on the second end of the rocker arm 25. An actuating rod 41 is fixedly fastened to the control bar 13, having a free end pressed on a switch 42 at a second air control valve 40, which is fixedly mounted on the other horizontal board 12. A connector 43 is provided at the top side of the second air control valve 40, and connected to the third port 22 of the tee 21 through an air pipe 431 for guiding air from the first air control valve 20 into the second air control valve 40. A connector 44 is provided at one lateral side of the second air control valve 40 opposite to the first air control valve 20 for connection to a presser foot (not shown). Further, a pull rod 16 is coupled to the base frame 1 and inserted through respective through holes at the lugs 11, having a top end coupled to a motor 50 through a link 51.

Figure 3A:
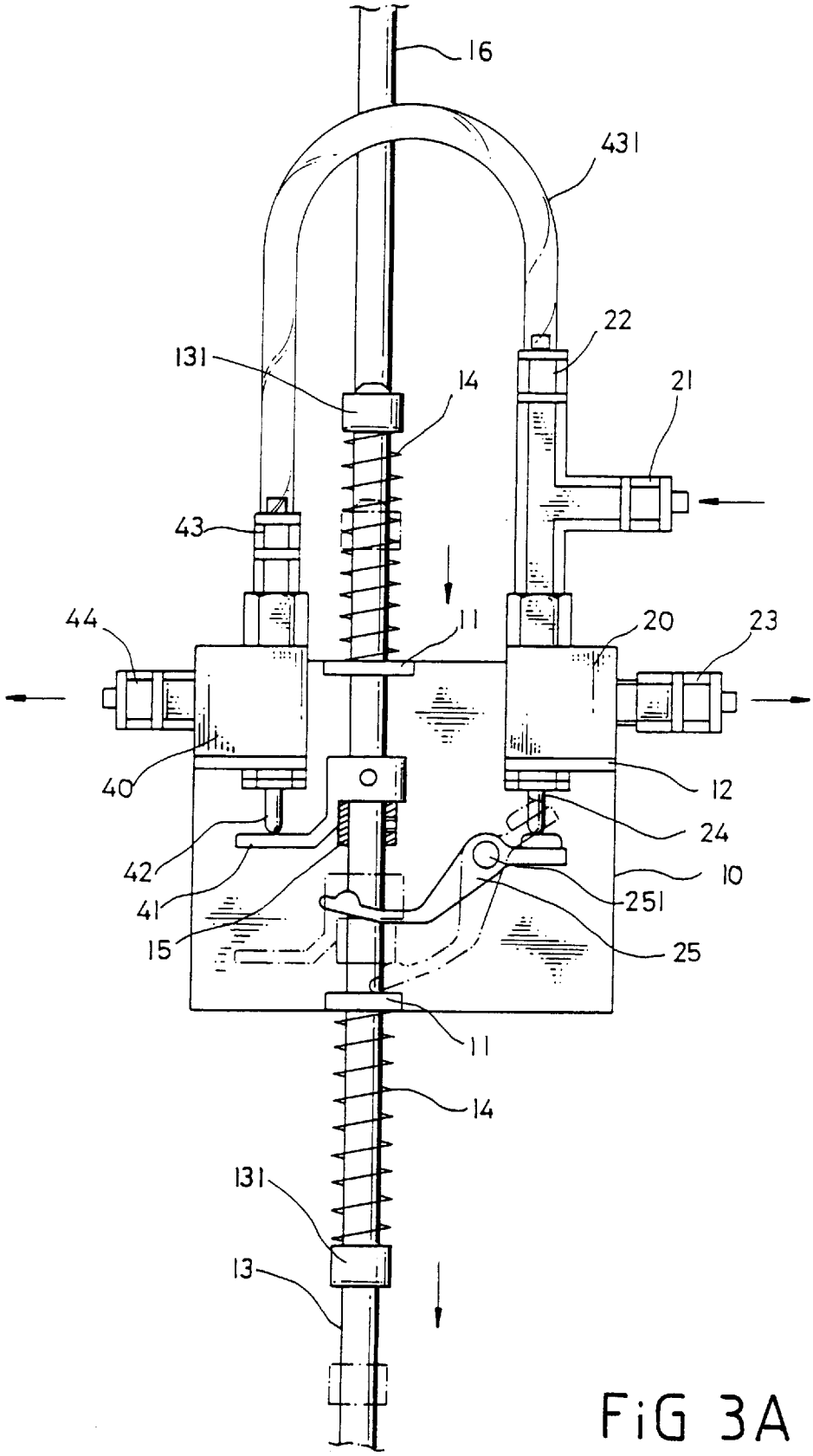
FIG. 3A illustrates the air control switch set operated.
Figure 3B:
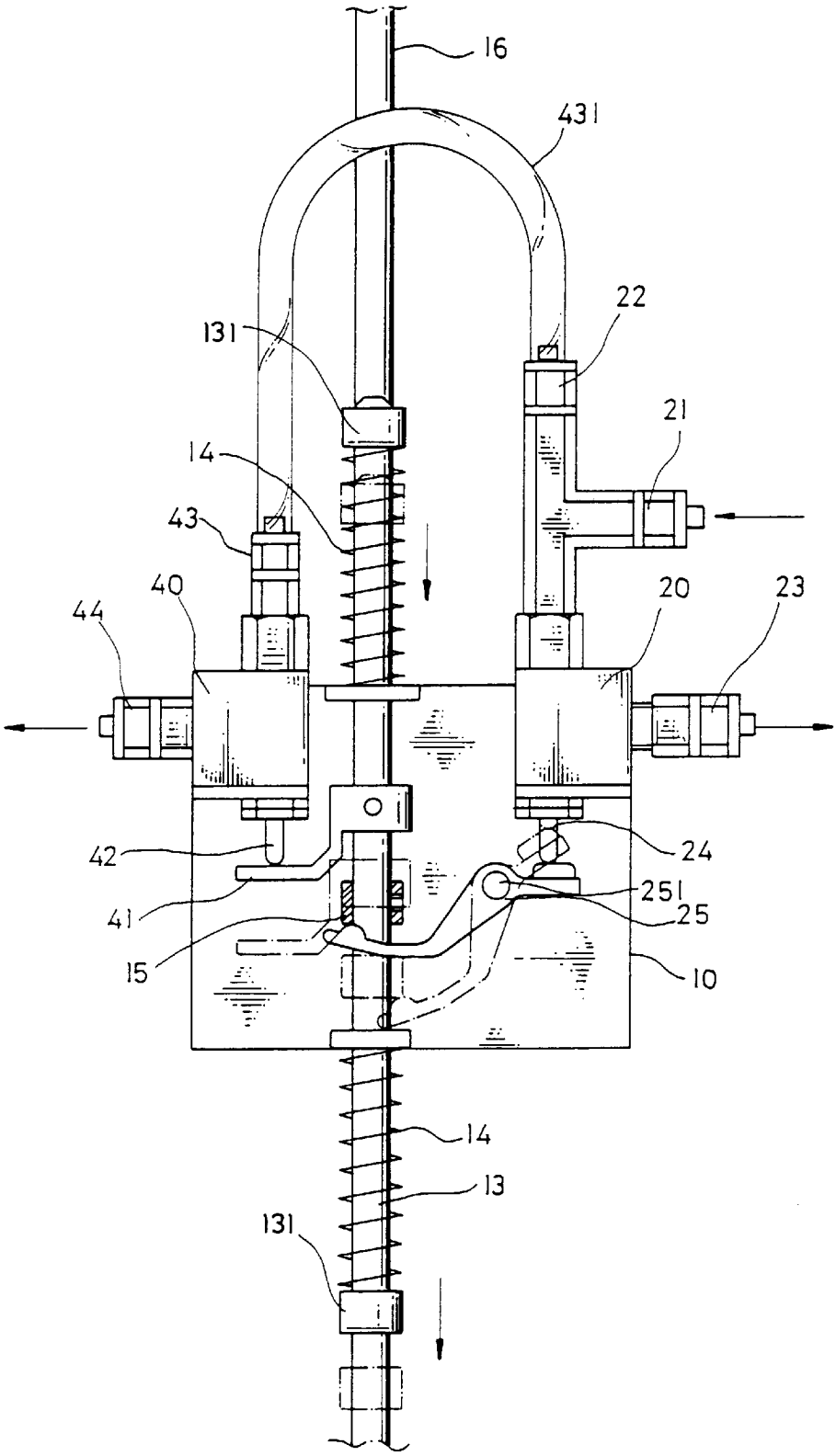
FIG. 3B is similar to FIG. 3A but showing the stop ring adjusted to a lower elevation on the control bar.
Figure 4:
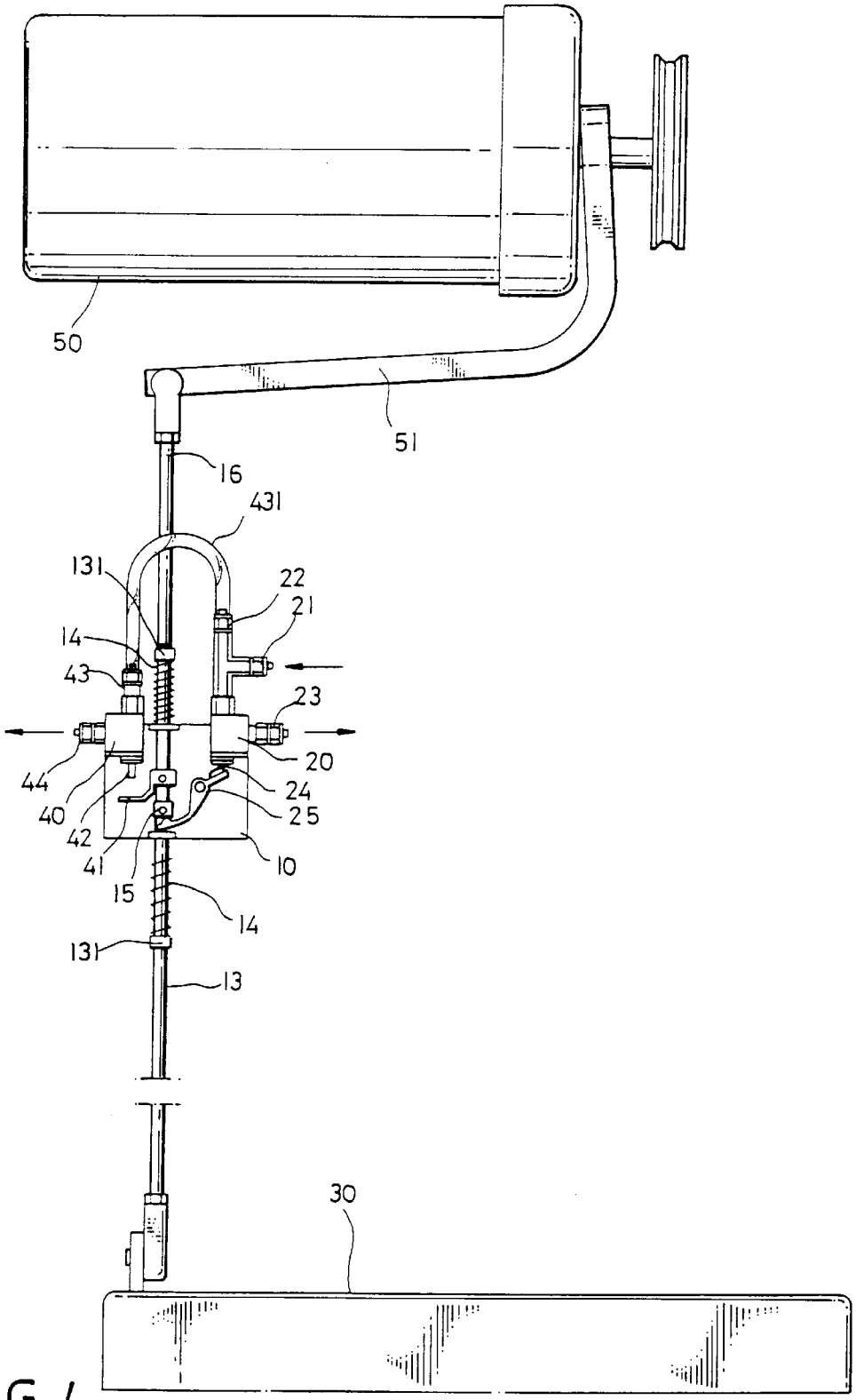

Referring to FIGS. 2, 3A and 3B again, when the pedal is pressed down, the control bar 13 is lowered, and the top-sided compression spring 14 is compressed. When the pedal 30 is released, the top-sided compression spring. 14 returns to its former shape and, imparts an upward pressure of the control bar 13, causing the control bar 13 to be pushed back to its former position. When the control bar 13 is lowered, the rocker arm 25 is forced by the stop ring 15 to turn about the pivot 251 in one direction, causing the first end of the rocker arm 25 to press on the switch 24, and therefore the first air control valve 20 is opened, enabling air to pass out of the second air control valve 20 through the connector 23 to air nozzle and thread suction device. When the pedal 30 is continuously turned downwards, the second end of the rocker arm 25 will be stopped at the bottom sided lug 11, causing the base frame 10 to be lowered with the control bar 13. When the base frame 10 is lowered, the pull rod 16 is lowered with the base frame 10, and the link 51 is moved by the pull rod 16 to start the motor 50, and therefore the thread head can be cut by the cutter (not shown) at a length in flush with the edge of the stitched object.

Referring to FIG. 2 again, when the pedal 30 is turned upwards, the control bar 13 is lifted to compress the bottom-sided compression spring 14, and the actuating rod 41 is lifted with the control bar 13 to press on the switch 42 of the second air control valve 40, and therefore the second air control valve 40 is opened, for enabling air to flow out of the second air control valve 40 to the presser foot (not shown). When the pedal 30 is released, the bottom-sided compression spring 14 immediately returns to its former shape, and imparts a downward pressure to the control bar 13, causing the control bar 13 to be moved to its former position.

Referring to FIGS. 3A and 3B again, the stop ring 15 can be adjusted on the control bar 13 to the desired elevation. When the stop ring 15 is adjusted to a higher elevation on the control bar 13, the distance between the stop ring 15 and the bottom-sided lug 11 is relatively extended, and it takes much time to force the rocker arm 25 to press on the switch 24 during down stroke of the control bar 13. i.e., the time in which air is guided into the first air control valve 20 is relatively extended. On the contrary, when the stop ring 15 is adjusted to a lower elevation on the control bar 13, the distance between the stop ring 15 and the bottom-sided lug 11 is relatively shortened, and it takes less time to force the rocker arm 25 to press on the switch 24 during down stroke of the control bar 13, i.e., the time in which air is guided into the first air control valve 20 is relatively shortened.

While only one embodiment of the present invention has been shown and described, it will be understood that various modifications and changes could be made thereunto without departing from the spirit and scope of the invention disclosed.

What the invention claimed is:

1. An air control switch set installed in an overedge sewing machine, comprising:

a base frame, said base frame comprising a first lug and a second lug disposed at different elevations and vertically arranged in a line, and a pivot;

a first air control valve fixedly mounted on said base frame, said first air control valve having an air input port connected to an air source, and an air output port connected to an air nozzle and thread suction device;

first switch means mounted in said first air control valve and controlled to open/close the air output port of said first air control valve;

a control bar inserted through the lugs at said base frame, said control bar having a top end extended out of the first lug at said base frame and a bottom end inserted through the second lug at said base frame and coupled to a pedal;

first spring means mounted on said control bar, said first spring means having a bottom end connected to the first lug at said base frame and a top end connected to the top end of said control bar;

second spring means mounted on said control bar, said second spring means having a bottom end connected to the bottom end of said control bar and a top end connected to the second lug at said base frame;

a pull rod having a bottom end fixedly connected to said base frame and a top end coupled to a motor through a link;

a stop member moved on said control bar between the lugs at said base frame, and fixed to said control bar at a desired elevation; and a rocker arm turned about said pivot at said base frame, said rocker arm having a first end disposed in contact with said first switch means and a second end suspended below said stop member;

wherein when said control bar is pulled downwards by the pedal, said stop member is lowered with said control bar to press on the second end of said rocker arm against said second lug at said base frame and turn said rocker arm about said pivot, causing the first end of said rocker arm to press on said first switch means in opening said first air control valve for letting air to pass to the air nozzle and thread suction device, and said base frame is lowered with said stop member during a down stroke of said control bar after the second end of said rocker arm has been pressed on said second lug by said stop member, causing said pull rod to be lowered with said base frame to move said link in turning on the motor.

2. The air control switch set of claim 1 wherein said stop member is a stop ring.

3. The air control switch set of claim 1 further comprising a second air control valve fixedly mounted on said base frame, said second air control valve having an air input port connected to the air input port of said first air control valve and the air source by an air tube and a tee and an air output port connected to a presser foot, a second switch means mounted in said second air control valve and controlled to open or close the air output port of said second air control valve, and an actuating rod fixedly connected to said control bar between said first lug and said second lug above said stop member and moved with said control bar to press on said second switch means in opening said second air control valve when said control bar is moved upwards to release said stop member from the second end of said rocker arm.

4. The air control switch set of claim 1 wherein said first spring means and said spring means are compression springs.

* * * * *